US009041607B2

(12) United States Patent
Yokoo et al.

(10) Patent No.: US 9,041,607 B2
(45) Date of Patent: May 26, 2015

(54) RADIO WAVE RECEIVER

(75) Inventors: Kazumasa Yokoo, Higashiyamato (JP); Junichi Sato, Hino (JP)

(73) Assignee: Casio Computer Co., Ltd, Tokyo (JP)

( * ) Notice: Subject to any disclaimer, the term of this patent is extended or adjusted under 35 U.S.C. 154(b) by 730 days.

(21) Appl. No.: 13/338,448

(22) Filed: Dec. 28, 2011

(65) Prior Publication Data

US 2012/0162030 A1 Jun. 28, 2012

(30) Foreign Application Priority Data

Dec. 28, 2010 (JP) ..... 2010-292155
Dec. 14, 2011 (JP) ..... 2011-273271

(51) Int. Cl.
*H01Q 1/24* (2006.01)
*G04R 60/12* (2013.01)

(52) U.S. Cl.
CPC ..... *G04R 60/12* (2013.01)

(58) Field of Classification Search
CPC ..... H01Q 1/243; H01Q 1/38; H01Q 9/0421
USPC ..... 343/702
See application file for complete search history.

(56) References Cited

U.S. PATENT DOCUMENTS

2006/0109188 A1* 5/2006 Ikeda et al. ..... 343/718
2008/0025152 A1* 1/2008 Yano et al. ..... 368/47

FOREIGN PATENT DOCUMENTS

| | | |
|---|---|---|
| JP | 57-198883 | 12/1982 |
| JP | 58-109079 | 7/1983 |
| JP | 58-109080 | 7/1983 |
| JP | 03-072392 | 3/1991 |
| JP | 03-109091 | 5/1991 |
| JP | 03-72392 | 7/1991 |
| JP | 03-109091 | 11/1991 |
| JP | 2007-263572 | 10/2007 |
| JP | 2008-076326 | 4/2008 |
| WO | 2004/055248 | 1/2004 |

OTHER PUBLICATIONS

Japanese Office Action for Japanese Application No. 2011-273271 mailed on Feb. 5, 2013.

* cited by examiner

*Primary Examiner* — Dameon E Levi
*Assistant Examiner* — Collin Dawkins
(74) *Attorney, Agent, or Firm* — Amin, Turocy & Watson, LLP

(57) ABSTRACT

The radio wave receiver includes the metallic case body, the metallic rear case, and the antenna inside the case body. The screw portion is formed in the metal wall of the case body. The coupling resin member having an electrical insulating property is coupled to the rear case through a great number of fine irregularities formed in the metal wall thereof. The screw portion which engages with the screw portion is formed on the coupling resin member. The case body and the rear case are coupled to each other with the screw portions. The case body and the rear case are electrically insulated from each other by the electrical insulating function of the coupling resin member so as to improve receiving sensitivity of the antenna.

2 Claims, 6 Drawing Sheets

RADIO WAVE RECEIVER

CROSS-REFERENCE TO RELATED APPLICATIONS

This application is based upon and claims the benefit of priority from the prior Japanese Patent Application No. 2010-292155 filed on Dec. 28, 2010, and the prior Japanese Patent Application No. 2011-273271 filed on Dec. 14, 2011, the entire contents of which are incorporated herein by reference.

BACKGROUND OF THE INVENTION

1. Field of the Invention

The present invention relates to a radio wave receiver.

2. Description of the Related Art

As one of radio wave receivers, there has conventionally been known a radio-controlled timepiece which includes a case body (device body) and an antenna to receive a standard radio wave (standard time and frequency signal) containing time data inside the case body, wherein the time is corrected based upon the standard radio wave received by the antenna.

The radio-controlled timepiece described above includes the one described below. Specifically, in order to achieve a high-quality appearance, the case body and a rear case as a closing member are made of a metal, and screw portions are formed on an inner peripheral wall surface of the case body and an outer peripheral wall surface of the rear case, wherein screw portions are engaged with each other so as to screw the case body and the rear case.

However, when the metallic case body and the metallic rear case are electrically conductive in the radio-controlled timepiece described above, an electric current circulating in the case body and the rear case increases, entailing a problem of a significant deterioration in the receiving sensitivity of the antenna.

In order to solve such problem, a radio-controlled timepiece described below has been proposed (for example, see Japanese Patent Application Laid-Open Publication No. 2008-76326). This radio-controlled timepiece has, inside the case body, an inner extending portion and a casing frame which is in contact with the inner extending portion through an insulating member. A screw portion on the rear case is screwed to a screw portion formed on the casing frame, whereby the case body and the rear case are electrically insulated.

There has also been proposed a radio-controlled timepiece as described below (e.g., see Japanese Patent Application Laid-Open Publication No. 2007-263572). In the radio-controlled timepiece, cutouts are formed in spots on a metallic projecting portion of the rear case, on which projecting portion a screw portion is formed, whereby the screw portion is divided by the cutouts. This decreases an area where the screw portion on the rear case and the screw portion on the case body screw together, so as to reduce the total area of the case body and the rear case, whereby the deterioration in the receiving sensitivity can be prevented.

However, the radio-controlled timepiece described in Japanese Patent Application Laid-Open Publication No. 2008-76326 employs the casing frame which is separately provided from the case body and the rear case, which might entail a problem of complicated attaching operation of the rear case to the case body. Moreover, since the radio-controlled timepiece has the casing frame inside the case body, the case body has to be enlarged.

Meanwhile, in the radio-controlled timepiece described in Japanese Patent Application Laid-Open Publication No. 2007-263572, though the area where the screw portions screw together can be decreased, since the screw portion on the rear case and the screw portion on the case body are in metallic contact, the electrical insulation between the case body and the rear case cannot surely be established. Further, since the cutouts are formed on the projecting portion on which the screw portion is formed, a coupling force between the case body and the rear case is decreased by the cutouts.

SUMMARY OF THE INVENTION

The present invention is accomplished in view of the foregoing problems, and the object of the present invention is to provide a radio wave receiver which surely establishes an electrical insulation between a device body and a closing member without reducing a coupling force between the device body and the closing member.

A radio wave receiver according to the present invention including: a cylindrical metallic device body; a first metallic closing member for closing an opening at a first end of the device body; a second closing member having a radio wave permeability for closing an opening at a second end of the device body; an antenna arranged in the device body; and a coupling resin member which has an electrical insulating property, and which is coupled through a great number of irregularities of a nanometer size formed on a metal wall surface of either one of the device body and the first closing member. The device body and the first closing member are screwed through engagement between a first screw portion formed in a metal wall surface of the other one of the device body and the first closing member and a second screw portion formed in a peripheral wall surface of the coupling resin member.

According to the present invention, a coupling resin member is coupled to either one of a metallic device body and a metallic first closing member which closes an opening at a first end of the device body, and the device body and the first closing member are screwed to each other through the coupling resin member. This structure can facilitate an operation of coupling the device body and the first closing member. Moreover, an electrical insulation between the device body and the first closing member can surely be established by the electrical insulating function of the coupling resin member, and another member is unnecessary for securing the electrical insulating property between the device body and the first closing member. Therefore, the radio wave receiver does not have to be enlarged.

Moreover, since the coupling resin member is fixedly coupled to a great number of irregularities of nanometer size formed on a metal wall surface, even when the assembling operation and disassembling operation are repeated, there is no possibility that the coupling resin member falls. Consequently, the electrical insulating property can surely be attained over a long period.

Furthermore, since an entire circumference of the first closing member is coupled to the device body, the device body and the first closing member are fixedly coupled to each other.

BRIEF DESCRIPTION OF THE SEVERAL VIEWS OF THE DRAWINGS

The present invention will sufficiently be understood by the following detailed description and accompanying drawing, but they are provided for illustration only, and not for limiting the scope of the invention.

DETAILED DESCRIPTION OF THE INVENTION

Embodiments of a radio-controlled timepiece as a radio wave receiver according to the present invention will be described below with reference to the drawings.

First Embodiment

Figure 1:
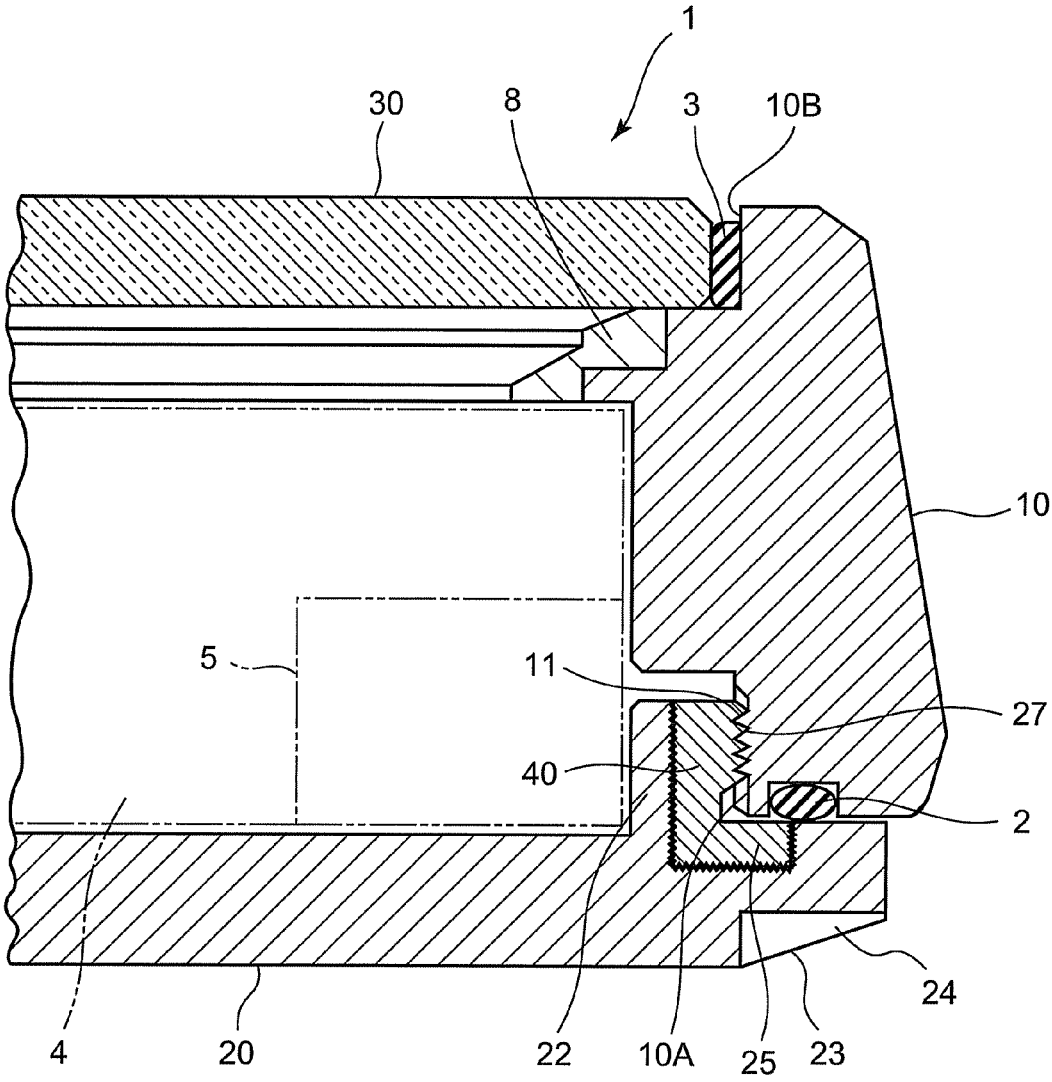
FIG. 1 is a sectional view illustrating a part of a radio-controlled timepiece according to a first embodiment of the present invention.
Figure 2:
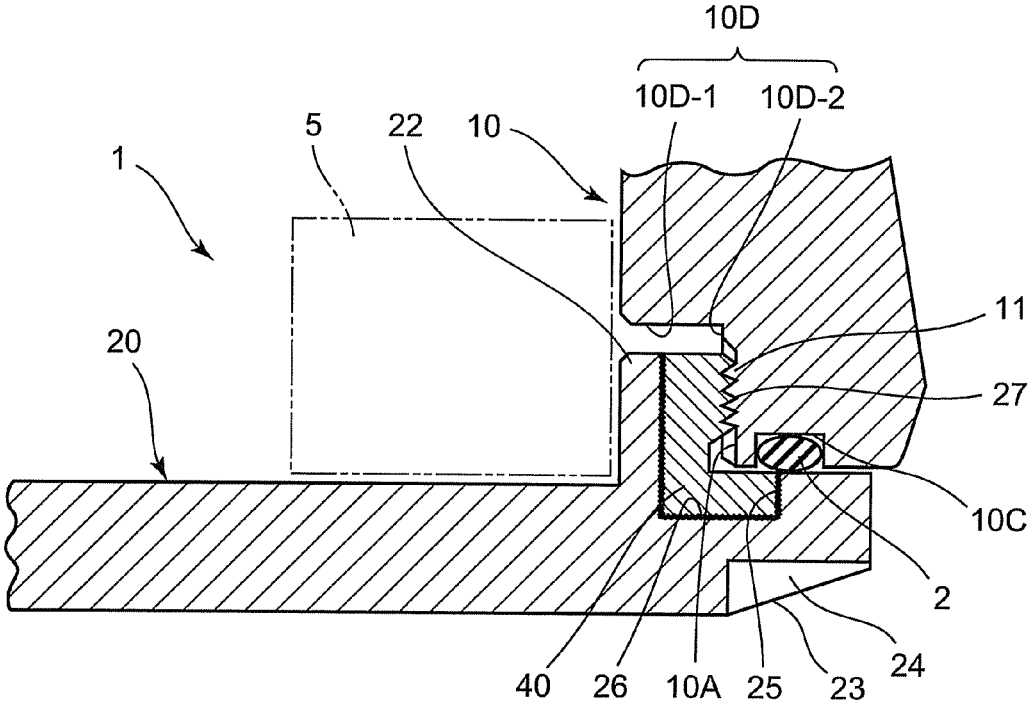
FIG. 2 is an enlarged sectional view illustrating main parts of a case body and a rear case of the radio-controlled timepiece in FIG. 1.

FIG. 1 is a sectional view illustrating a part of a radio-controlled timepiece according to the first embodiment of the present invention, and FIG. 2 is an enlarged sectional view illustrating main parts of a case body and a rear case of the radio-controlled timepiece.

A radio-controlled timepiece 1 according to the first embodiment includes a case body 10 which is a cylindrical device body, a rear case 20 as a first closing member, and a timepiece glass 30 as a second closing member 30. An opening 10A at one end (first end) of the case body 10 is closed by the rear case 20, while an opening 10B at the other end (second end) of the case body 10 is closed by the timepiece glass 30 having radio wave permeability. A seal member 2 is interposed between the case body 10 and the rear case 20, while a seal member 3 is interposed between the case body 10 and the timepiece glass 30. With this structure, water-proof property in the case body 10 is secured.

Inside the case body 10, a timepiece module 4, an antenna 5 for receiving a standard radio wave containing time data, a corner end member 8, and not illustrated dials, hands, and so on are housed.

The case body 10 is made of a metal such as titanium, and is formed into a cylindrical shape. As illustrated in FIG. 2, an annular groove 10C for mounting the seal member 2 is formed on a bottom end face of the case body 10. An annular step portion 10D is formed on an inner periphery of a bottom end portion of the case body 10. The annular step portion 10D includes a wall surface 10D-1 facing downward and a wall surface 10D-2 facing a center of the case body 10. The wall surfaces 10D-1 and 10D-2 are metallic wall surfaces. The wall surface 10D-2 forms a part of an inner peripheral wall surface of the case body 10, wherein a first screw portion 11 including a female screw is formed on the inner peripheral wall surface.

Figure 3A:
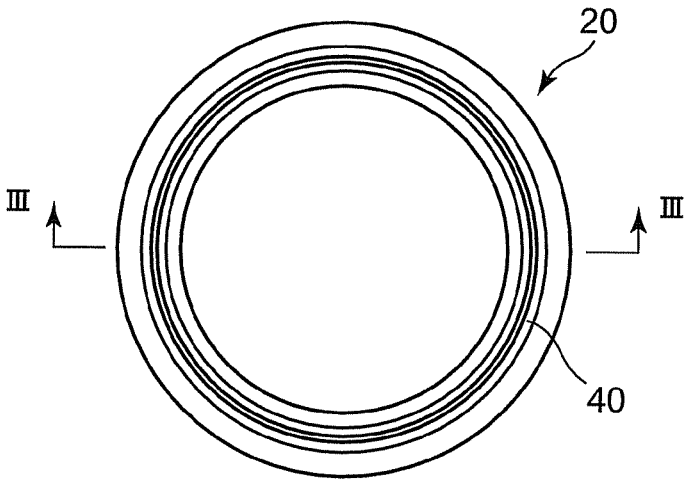
FIG. 3A is a plan view illustrating the rear case of the radio-controlled timepiece in FIG. 1.
Figure 3B:
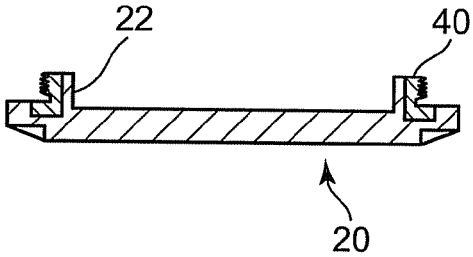
FIG. 3B is a sectional view taken along a line A-A in FIG. 3A.
Figure 3C:
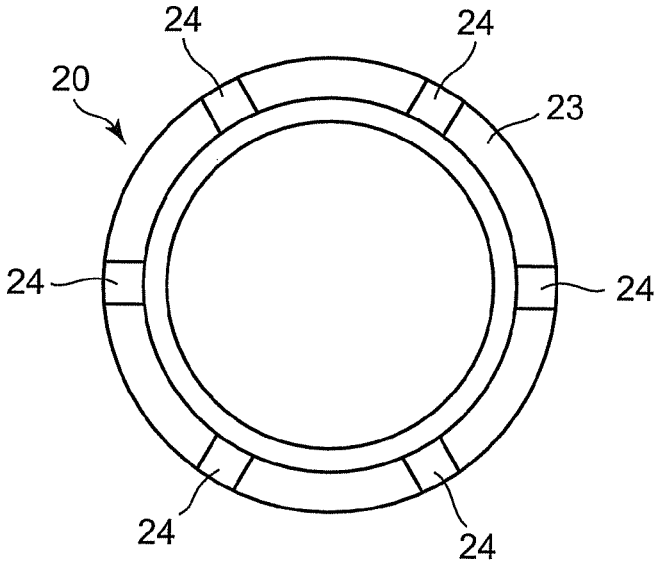
FIG. 3C is a bottom view illustrating the rear case of the radio-controlled timepiece in FIG. 1.

FIGS. 3A to 3C illustrate the rear case 20 of the radio-controlled timepiece 1, wherein FIG. 3A is a plan view, FIG. 3B is a sectional view taken along a line A-A in FIG. 3A, and FIG. 3C is a bottom view.

The rear case 20 is made of a metal, e.g., titanium, and is formed into a disc-like shape.

An annular protruding portion 22 which is provided to stand on the inner surface of the rear case 20 is formed in the vicinity of a peripheral edge of the rear case 20. An outer diameter of the annular protruding portion 22 is set to be smaller than a diameter of a circle enclosed by the wall surface 10D-2 of the case body 10. A top wall surface of the annular protruding portion 22 faces the wall surface 10D-1 of the case body 10, while an outer peripheral wall surface of the annular protruding portion 22 faces the wall surface 10D-2 of the case body 10.

An annular recessed portion 25 is formed on the inner surface of the rear case 20 just outside the annular protruding portion 22 so as to enclose the annular protruding portion 22. The wall surface of the annular recessed portion 25 is a metallic wall surface. An inner peripheral wall surface, out of wall surfaces of the annular recessed portion 25, is flush with the outer peripheral wall surface of the annular protruding portion 22. A great number of irregularities (asperities) 26 (see FIG. 4B) of a nanometer size are formed on the wall surfaces of the annular recessed portion 25 and the outer peripheral wall surface of the annular protruding portion 22. The nanometer size means the size of 10 to 300 nm. In the present embodiment, a diameter of each ultrafine hole of the great number of irregularities 26 is within the range of 10 to 100 nm. Alternatively, the diameter of the ultrafine hole of the present invention can be within the range of 20 to 300 nm, or the range of 20 to 30 nm, for example.

A coupling resin member 40 is coupled to the rear case 20 through the great number of irregularities 26. The coupling resin member 40 is formed over the annular recessed portion 25 and the outer peripheral wall surface of the annular protruding portion 22, thereby covering the annular recessed portion 25 and the outer peripheral wall surface of the annular protruding portion 22. The outer peripheral wall surface of the annular coupling resin member 40 faces the wall surface 10D-2 of the case body 10, and a second screw portion 27 including a male screw is formed on the outer peripheral wall surface of the annular coupling resin member 40. The second screw portion 27 is engaged with the first screw portion 11 on the case body 10, whereby the case body 10 and the rear case 20 are screwed.

It is preferable that the coupling resin member 40 is formed at the position which cannot visually be observed from the outside when the rear case 20 is coupled to the case body 10.

A tilt surface 23 is formed on a peripheral edge of an outer surface of the rear case 20. On the tilt surface 23, six cutouts 24 are formed at regular intervals in a circumferential direction. The cutouts 24 are portions at which a pawl of a hooking spanner is hooked when the rear case 20 is turned with respect to the case body 10.

Next, a method of manufacturing the rear case 20 with the coupling resin member 40 will be described.

A manufacturing method by an integral molding technique with an injection molding of a metallic member and a resin member is employed.

Specifically, the manufacturing method employs a technique in which fine irregularities of a nanometer size are formed on a metal surface with a surface treatment to the metallic member, and a hard resin is filled in the irregularities by an injection molding method so as to integrate the metallic member and the resin member. This technique is well known, so that it will not be described.

The manufacturing procedure will be described below.

Figure 4A:
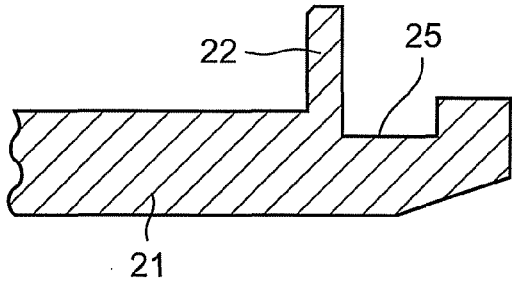
FIG. 4A is a sectional view illustrating a procedure of coupling a coupling resin member on the rear case in FIG. 2, and illustrating a main part of the rear case before the coupling resin member is coupled.

As illustrated in FIG. 4A, a rear case body 21 on which the annular protruding portion 22 and the annular recessed portion 25 are formed is prepared. The rear case body 21 may be made of at least one type of a metal selected from a group consisting of titanium, aluminum, nickel, iron, manganese, copper, molybdenum, cobalt, tungsten, magnesium, and an alloy which contains at least one of these metallic elements. Out of these, the iron alloy contains a stainless steel (SUS304, SUS316L, SUS316F), the titanium contains pure Ti, and the titanium alloy contains 64 titanium, for example. The 64 titanium alloy (alloy containing about 6% of aluminum, about 4% of vanadium, and about 90% of titanium) is more preferable out of these metal materials. It is preferable that the case body 10 is made of the metal material same as that for the rear case body 21.

The rear case body 21 is then immersed into an alkali solution, undergoes a defatting process, and then, immersed into an acid solution to be neutralized.

Figure 4B:
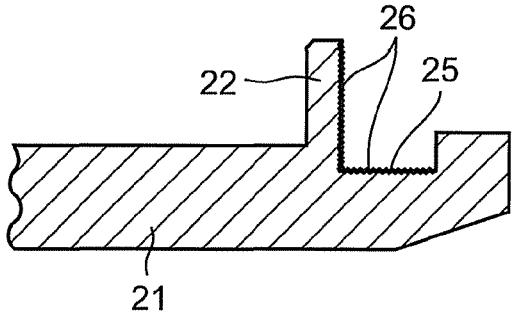
FIG. 4B is a sectional view illustrating the procedure of coupling the coupling resin member on the rear case in FIG. 2, and illustrating a main part of the rear case after many irregularities are formed.

Subsequently, the rear case body 21 is immersed into corrosive aqueous solution or corrosive suspension so as to form a great number of irregularities 26, each having a diameter and depth of a nanometer size, over the outer peripheral wall surface of the annular protruding portion 22 and the wall surface of the annular recessed portion 25 as illustrated in FIG. 4B. The diameter and depth of each hollow constituting the great number of irregularities 26 are about 20 nanometers in the present embodiment. However, the diameter and depth thereof are not limited thereto, and they may have another size.

Thereafter, the rear case body 21 is washed with water, and dried by a dryer.

Figure 4C:
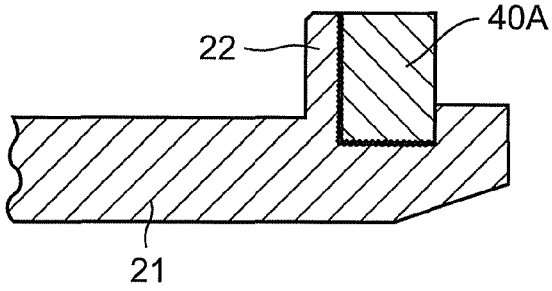
FIG. 4C is a view illustrating the procedure of coupling the coupling resin member on the rear case in FIG. 2, and illustrating main parts of the rear case and the coupling resin member after the coupling resin member is coupled through many irregularities.

Next, the rear case body 21 is put into a metallic mold, and a mold resin, e.g., polyphenylene sulfide (PPS), is filled in the outer peripheral wall surface of the annular protruding portion 22 and the annular recessed portion 25 by the injection molding, so as to form a resin block 40A as illustrated in FIG. 4C.

The polyphenylene sulfide (PPS) is merely used, or it is used as a mixture of (A) a resin composition containing 70 to 99 wt. % of polyphenylene sulfide and 1 to 30 wt. % of polyolefin resin, and (B) a resin composition containing 70 to 99 wt. % of polyphenylene sulfide, and 1 to 30 wt. % of one or more polyolefin resins selected from maleic anhydride modified ethylene copolymer, glycidyl methacrylate-modified ethylene copolymer, glycidyl ether-modified ethylene copolymer, and ethylene-alkyl acrylate copolymer.

In the present embodiment, the polyphenylene sulfide (PPS) is used as the molding resin. However, the molding resin is not limited thereto. For example, a material containing 20% of glass fiber into the polyphenylene sulfide (PPS), or polyether imide (PEI), polyether ketone (PEEK), polyamide imide (PAI), or polyarylate (AXG) may be used.

Figure 4D:
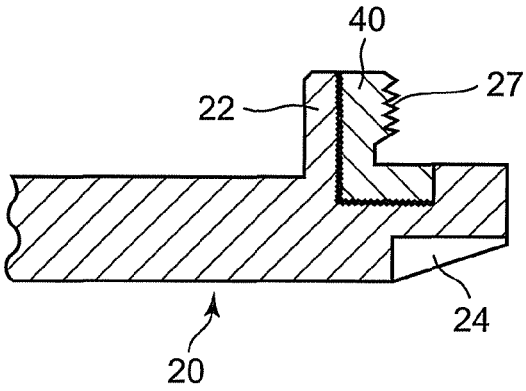
FIG. 4D is a view illustrating the procedure of coupling the coupling resin member on the rear case in FIG. 2, and illustrating a main part of the rear case which is completed by forming a screw portion on the coupling resin member.

Then, a surface of the rear case body 21 is cut, and an outer peripheral wall surface of the resin block 40A is cut so as to form the second screw portion 27, and thereafter, the whole is polished, and the cutout 24 is formed, as illustrated in FIG. 4D. Thus, the rear case 20 with the coupling resin member 40 on which the second screw portion 27 is formed is manufactured.

The radio-controlled timepiece 1 according to the first embodiment can provide effects as described below.

Specifically, in the radio-controlled timepiece 1 according to the first embodiment, the metallic case body 10 and the metallic rear case 20 are screwed with the first screw portion 11 on the case body 10 and the second screw portion 27 on the coupling resin member 40, and the case body 10 and the rear case 20 can surely be electrically insulated from each other due to the electrical insulation by the coupling resin member 40. This can surely prevent the situation in which an electric current by an electromotive force generated in the antenna 5 when receiving radio wave from the outside flows into the metallic rear case 20 from the metallic case body 10 or flows into the metallic case body 10 from the metallic rear case 20, and the situation in which overcurrent loss is caused. Accordingly, the receiving sensitivity of the antenna 5 can be enhanced according to the prevention of the overcurrent loss.

Since the coupling resin member 40 is formed integrally with the rear case 20 through the great number of irregularities 26 (see FIG. 4B) of nanometer size, the operation of coupling the rear case 20 to the case body 10 is facilitated. Another member is unnecessary for securing the electrical insulating property. Therefore, the radio-controlled timepiece 1 does not have to be enlarged.

The coupling resin member 40 is fixedly coupled to the rear case 20 through the great number of irregularities 26 of a nanometer size. Therefore, even when the assembling operation and disassembling operation are repeated, there is no possibility that the coupling resin member 40 falls. Consequently, the electrical insulating property can surely be attained over a long period.

The entire circumference of the rear case 20 is coupled to the case body 10. Therefore, the case body 10 and the rear case 20 are fixedly coupled to each other, whereby the radio-controlled timepiece 1 having excellent water-proof property can be realized.

Second Embodiment

Figure 5:
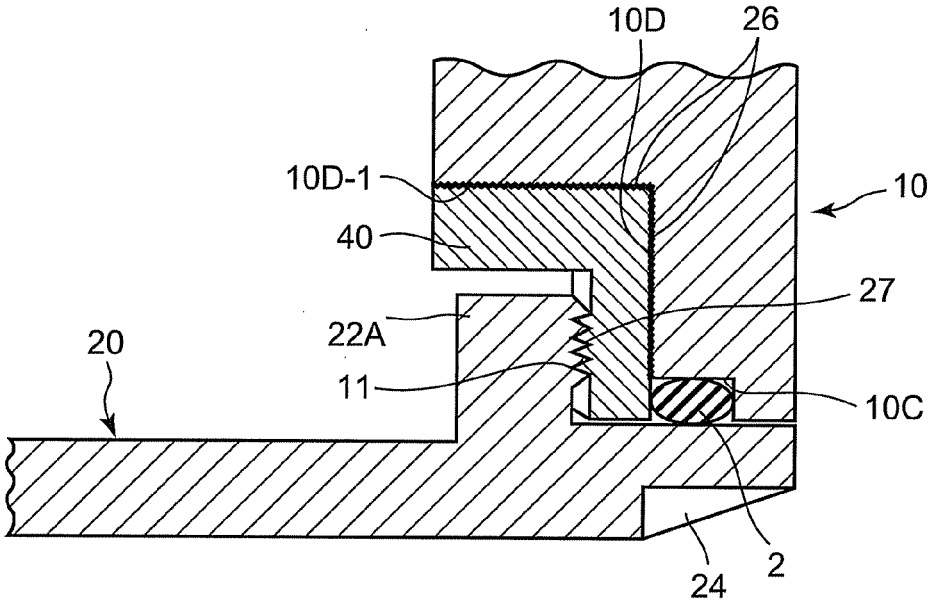
FIG. 5 is a sectional view illustrating main parts of a case body and a rear case in a radio-controlled timepiece according to a second embodiment of the present invention.

FIG. 5 is a sectional view illustrating main parts of the case body 10 and the rear case 20 of the radio-controlled timepiece 1 according to the second embodiment.

The radio-controlled time piece 1 in the second embodiment is different from the radio-controlled timepiece 1 in the first embodiment in that the coupling resin member 40 is coupled to the case body 10, not to the rear case 20.

Specifically, in the radio-controlled timepiece 1 according to the second embodiment, a metallic annular protruding portion 22A formed with the screw portion 27 is provided to the rear case 20. On the other hand, a great number of irregularities 26 of a nanometer size are formed on the wall surface 10D-1 of the case body 10 facing a top wall surface of the annular protruding portion 22A and on the wall surface 10D-2 of the case body 10 facing an outer peripheral wall surface of the annular protruding portion 22A. The coupling resin member 40 is coupled to the case body 10 through the great number of irregularities 26. The screw portion 11 is also formed in the coupling resin member 40.

A wall surface on an inner periphery side of the annular groove 10C, which is formed on the bottom surface of the case body 10, is formed by the wall surface of the coupling resin member 40. The annular groove 10C is formed, for example, by forming in the case body 10 a step portion to become the bottom wall surface and the wall surface on an outer periphery side of the annular groove 10C, forming the great number of irregularities 26 also on the step portion, coupling the coupling resin member 40 also to the irregularities 26 on the step portion and then cutting a part of the coupling resin member 40.

The other configurations of the radio-controlled timepiece 1 according to the second embodiment are the same as those of the radio-controlled timepiece 1 according to the first embodiment. Therefore, the description and illustration will be omitted.

The radio-controlled timepiece 1 according to the second embodiment can provide effects as described below.

Specifically, according to the radio-controlled timepiece 1 of the second embodiment, the coupling resin member 40 is formed integrally with the case body 10. Therefore, the operation of coupling the rear case 20 to the case body 10 can be facilitated. Another member is unnecessary for securing the electrical insulating property. Therefore, the radio-controlled timepiece 1 does not have to be enlarged.

The coupling resin member 40 is fixedly coupled to the case body 10. Therefore, even when the assembling operation and disassembling operation are repeated, there is no possibility that the coupling resin member 40 falls. Consequently, the electrical insulating property can surely be attained over a long period.

The entire circumference of the rear case 20 is coupled to the case body 10. Therefore, the case body 10 and the rear case 20 are fixedly coupled to each other, whereby the radio-controlled timepiece 1 having excellent water-proof property can be realized.

Third Embodiment

Figure 6:
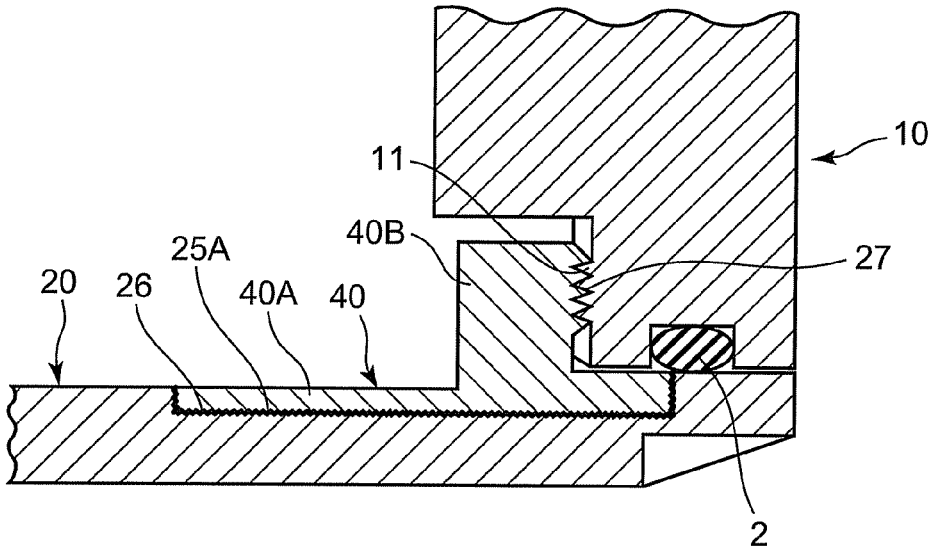
FIG. 6 is a sectional view illustrating main parts of a case body and a rear case in a radio-controlled timepiece according to a third embodiment of the present invention.

FIG. 6 is a sectional view illustrating main parts of the case body 10 and the rear case 20 in the radio-controlled timepiece 1 according to the third embodiment.

The radio-controlled time piece 1 in the third embodiment is different from the radio-controlled timepiece 1 in the first embodiment in that the rear case 20 does not have the metallic annular protruding portion 22.

Specifically, in the radio-controlled timepiece 1 according to the third embodiment, an annular recessed portion 25A is formed in the rear case 20, and a great number of irregularities 26 of nanometer size are formed on the wall surface of the annular recessed portion 25A. The coupling resin member 40 is coupled to the rear case 20 through the great number of irregularities 26. The coupling resin member 40 includes a filling portion 40A which is coupled to the wall surface of the annular recessed portion 25A through the great number of irregularities 26 and fills the annular recessed portion 25A, and an annular protruding portion 40B which is consecutively formed with the filling portion 40A and which has the screw portion 27 formed thereon. The screw portion 27 is formed on the annular protruding portion 40B.

The other configurations of the radio-controlled timepiece 1 according to the third embodiment are the same as those of the radio-controlled timepiece 1 according to the first embodiment. Therefore, the description and illustration will be omitted.

The radio-controlled timepiece 1 according to the third embodiment can provide effects as described below.

Specifically, the radio-controlled timepiece 1 according to the third embodiment not only provides the effects same as those of the radio-controlled timepiece 1 according to the first embodiment, but also can eliminate a step of cutting the metallic annular protruding portion 22, since the metallic annular protruding portion 22 is not formed, and can enhance a through-put upon manufacturing the rear case 20, since the filling portion 40A and the annular protruding portion 40B can simultaneously be formed.

Fourth Embodiment

Figure 7:
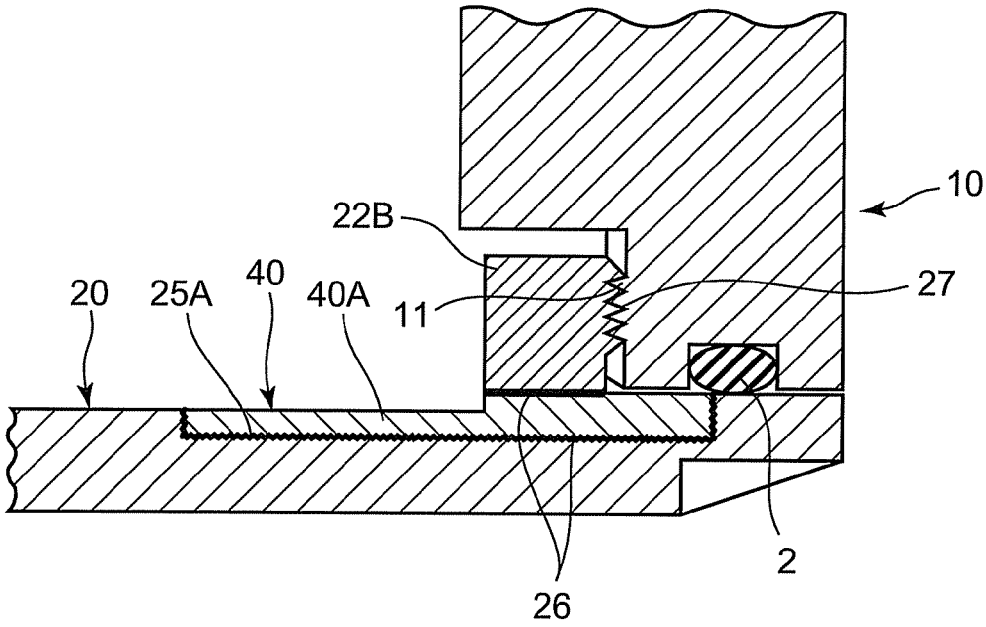
FIG. 7 is a sectional view illustrating main parts of a case body and a rear case in a radio-controlled timepiece according to a fourth embodiment of the present invention.

FIG. 7 is a sectional view illustrating main parts of the case body 10 and the rear case 20 in the radio-controlled timepiece 1 according to the fourth embodiment.

The radio-controlled time piece 1 in the fourth embodiment is different from the radio-controlled timepiece 1 in the third embodiment in that the rear case 20 has a metallic annular member 22B instead of the annular protruding portion 40B in the radio-controlled timepiece 1 in the third embodiment. A great number of irregularities 26 of nanometer size are formed on the wall surface at a bottom end of the metallic annular member 22B. The annular member 22B is coupled to the filling portion 40A through the great number of irregularities 26. The manner of coupling is the same as that in the first embodiment.

The other configurations of the radio-controlled timepiece 1 according to the fourth embodiment are the same as those of the radio-controlled timepiece 1 according to the third embodiment. Therefore, the description and illustration will not be repeated.

The radio-controlled timepiece 1 according to the fourth embodiment can provide effects as described below.

Specifically, the radio-controlled timepiece 1 according to the fourth embodiment not only provides the effects same as those of the radio-controlled timepiece 1 according to the third embodiment, but also can provide the screw portion 27 having high strength and coupling force depending upon the selection of the metal for the annular member 22B.

As described above, as shown in FIGS. 2, 5, and 6, a radio wave receiver (1) of the present embodiment includes: a cylindrical metallic device body (10); a first metallic closing member (20) for closing an opening at a first end of the device body (10); a second closing member (30) having a radio wave permeability for closing an opening at a second end of the device body (10); an antenna (5) arranged in the device body (10); and a coupling resin member (40) which has an electrical insulating property, and which is coupled through a great number of irregularities (26) of a nanometer size formed on a metal wall surface of either one of the device body (10) and the first closing member (20). The device body (10) and the first closing member (20) are screwed through engagement between a first screw portion (11, 27) formed in a metal wall surface of the other one of the device body (10) and the first closing member (20) and a second screw portion (11, 27) formed in a peripheral wall surface of the coupling resin member (40).

Preferably, as shown in FIGS. 2 and 6, the coupling resin member (40) is coupled to the first closing member (20) through the great number of irregularities (26), and the first screw portion (11) is formed in the metal wall surface of the device body (10).

Preferably, as shown in FIG. 5, the coupling resin member (40) is coupled to the device body (10) through the great number of irregularities (26), and the first screw portion (27) is formed in the metal wall surface of the first closing member (20).

Preferably, as shown in FIG. 2, the great number of irregularities (26) are formed on an outer peripheral wall surface of an annular protruding portion (22) provided to stand on an inner surface of the first closing member (20) and on a wall surface of an annular recessed portion (26) enclosing the annular protruding portion, and the coupling resin member (40) is coupled to the outer peripheral wall surface of the annular protruding portion and to the wall surface of the annular recessed portion through the great number of irregularities (26).

Preferably, as shown in FIG. 5, the first screw portion (27) is formed in an outer peripheral wall surface of an annular protruding portion (22) provided to stand on an inner surface of the first closing member (20), the great number of irregularities (26) are formed on a first wall surface (10D-1) facing a top wall surface of the annular protruding portion and on a second wall surface (10D-2) facing the outer peripheral wall surface of the annular protruding portion, and the coupling resin member (40) is coupled to the first wall surface and to the second wall surface through the great number of irregularities (26).

Preferably, as shown in FIG. 6, the great number of irregularities (26) are formed on a wall surface of an annular recessed portion (26) formed in an inner surface of the first closing member (20), and the coupling resin member (40) includes a filling portion (40A) which is coupled to the wall surface of the annular recessed portion through the great number of irregularities (26) for filling the annular recessed portion, and an annular protruding portion (40B) which is consecutively formed with the filling portion and in which a second screw portion (27) is formed.

Meanwhile, as shown in FIG. 7, a radio wave receiver (1) of the present embodiment includes: a cylindrical metallic device body (10); a first metallic closing member (20) for closing an opening at a first end of the device body (10); a second closing member (30) having a radio wave permeability for closing an opening at a second end of the device body (10); an antenna (5) arranged in the device body (10); and first and second screw portions (11, 27) which screw the device body and the first closing member through engagement between the first and second screw portions. The first screw portion (11) is formed in a metal wall surface of the device body (10), the second screw portion (27) is formed in a metallic annular member (22B) which is mounted to the first closing member (20) through a coupling resin member (40), and the coupling resin member (40) is coupled to a metal wall surface of an annular recessed portion (25A) formed in an inner surface of the first closing member (20), through a great number of irregularities (26) of a nanometer size formed on the metal wall surface of the annular recessed portion (25A), and coupled to a metal wall surface of the annular member (22B) through a great number of irregularities (26) of a nanometer size formed on the metal wall surface of the annular member (22B).

Preferably, the device body (10) and the first closing member (20) are made of at least one type of a metal selected from a group consisting of an alloy which contains, as a major component, at least one type of a metallic element of titanium, stainless steel (SUS304, SUS316L, SUS316F), pure titanium, 64 titanium alloy, aluminum, nickel, iron, manganese, copper, molybdenum, cobalt, tungsten, and magnesium, and the coupling resin member is made of at least one type of resin selected from polyphenylene sulfide (PPS), polybutylene terephthalate (PBT), polyamide (nylon PA6, PA66), and polyphthalamide (PPA).

The embodiments of the present invention have been described above. However, the present invention is not limited thereto, and various modifications are possible without departing from the scope of the invention.

For example, in the radio-controlled timepieces in the above-mentioned embodiments, the case body 10 and the rear case 20 are made of titanium. However, the present invention is applicable to a radio-controlled timepiece in which the case body 10 and the rear case 20 are made of an aluminum member, an aluminum alloy member, a magnesium member, a magnesium alloy member, a copper member, a copper alloy member, a titanium alloy member, a stainless member, an iron member, or a brass member.

Polybutylene terephthalate (PBT), polyamide (nylon PA6, PA66), polyphthalamide (PPA), and the like can be used as the molding resin, instead of the above-mentioned materials.

A glass fiber, carbon fiber, aramid fiber, calcium carbonate, silica, talc, clay, glass, and the like can be used as a filling agent added to the molding resin. However, it is not limited thereto.

Hydrazine, ammonium, aqueous amines, alkaline-earth metal hydroxide, and the like can be used as the corrosive aqueous solution or corrosive suspension, but it is not limited thereto.

The present invention is applied to a radio-controlled timepiece in the above-mentioned embodiments. However, the present invention can be applied to other radio wave receivers.

What is claimed is:

1. A radio wave receiver comprising:

a cylindrical metallic device body;

a first metallic closing member for closing an opening at a first end of the device body;

a second closing member having a radio wave permeability for closing an opening at a second end of the device body;

an antenna arranged in the device body; and first and second screw portions which screw the device body and the first closing member through engagement between the first and second screw portions, wherein the first screw portion is formed in a metal wall surface of the device body, the second screw portion is formed in a metallic annular member which is mounted to the first closing member through a coupling resin member, the metallic annular member being mounted on an upper section of the coupling resin member, and the coupling resin member is coupled to a metal wall surface of an annular recessed portion formed in an inner surface of the first closing member, through a great number of irregularities of a nanometer size formed on the metal wall surface of the annular recessed portion, and coupled to a metal wall surface of the annular member through a great number of irregularities of a nanometer size formed on the metal wall surface of the annular member.

2. The radio wave receiver according to claim 1, wherein the device body and the first closing member are made of at least one type of a metal selected from a group consisting of titanium, aluminum, nickel, iron, manganese, copper, molybdenum, cobalt, tungsten, magnesium, and an alloy which contains at least one of these metallic elements, and the coupling resin member is made of at least one type of resin selected from polyphenylene sulfide, polybutylene terephthalate, polyamide, and polyphthalamide.

* * * * *